US005125591A

United States Patent [19]

Byars

[11] Patent Number: 5,125,591

[45] Date of Patent: * Jun. 30, 1992

[54] YARN PACKAGE HOLDER

[75] Inventor: Larry W. Byars, Greenville, S.C.

[73] Assignee: Exim Ltd., Greenville, S.C.

[ * ] Notice: The portion of the term of this patent subsequent to Aug. 13, 2008 has been disclaimed.

[21] Appl. No.: 603,374

[22] Filed: Oct. 26, 1990

Related U.S. Application Data

[63] Continuation-in-part of Ser. No. 511,797, Apr. 20, 1990, Pat. No. 5,039,026.

[51] Int. Cl.[5] ..... B65H 49/06

[52] U.S. Cl. ..... 242/130; 242/129.7; 242/131

[58] Field of Search ..... 242/130, 129.5, 129.7, 242/129.71, 130.1, 130.2, 130.3, 130.4, 131, 131.1, 134, 139, 141, 55.2, 55.54, 68

[56] References Cited

U.S. PATENT DOCUMENTS

| | | | |
|---|---|---|---|
| 1,508,105 | 9/1924 | Kamla | 242/130.1 X |
| 2,283,373 | 5/1942 | Krafft | 242/130.1 X |
| 2,437,888 | 3/1948 | Narki | 242/129.7 X |
| 4,728,055 | 3/1988 | Wright, Jr. et al. | 242/130 |
| 4,760,977 | 8/1988 | Wright, Jr. et al. | 242/130 |
| 4,824,042 | 4/1989 | Whitaker et al. | 242/130 |
| 4,880,184 | 11/1989 | Crow | 242/130 |
| 5,039,026 | 8/1991 | Byars | 242/130 |

*Primary Examiner*—Stanley N. Gilreath
*Attorney, Agent, or Firm*—Brady, O'Boyle & Gates

[57] ABSTRACT

A yarn package holder for accommodating yarn package tubes and cones of various sizes, wherein a fixed, cantilevered contact arm is provided with a separate layer of friction material providing a friction surface and has one end of a first spring member pivotally connected to the distal end thereof, and one end of a second spring member fixedly connected to the other end thereof. The friction surface engages the inner wall surface of the tube or cone on one side thereof and the free end of the first spring member engages the inner wall surface of the tube or cone on the opposite side thereof, and the free end of the second spring member engages the first spring member intermediate the ends thereof to provide a displaceable fulcrum therewith. An equal biasing force is applied to the inside surface of the tubes or cones no matter what their size might be.

8 Claims, 3 Drawing Sheets

FIG.1
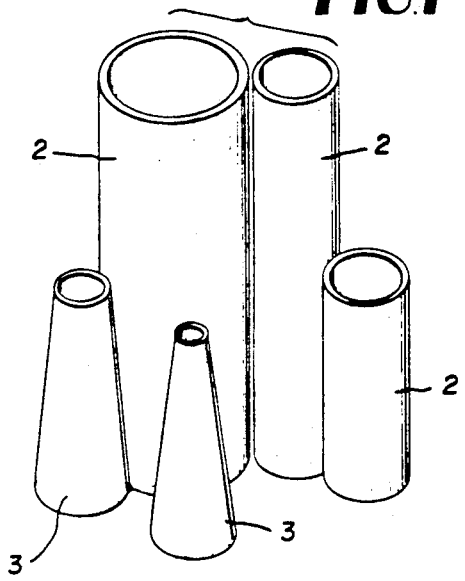
FIG.2
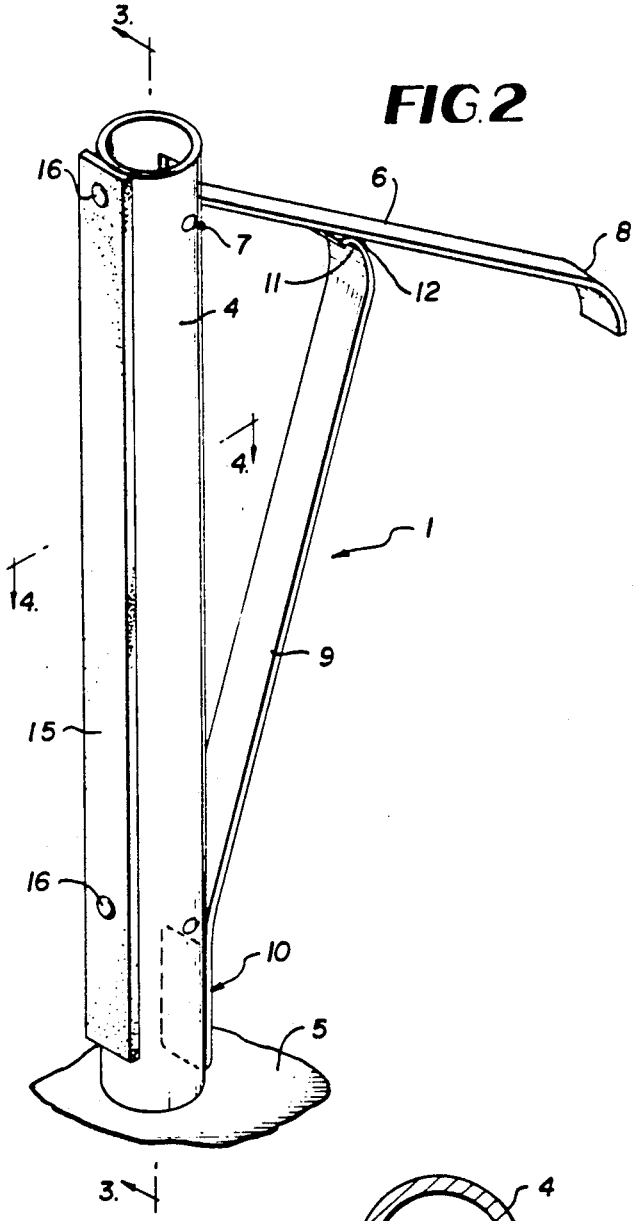
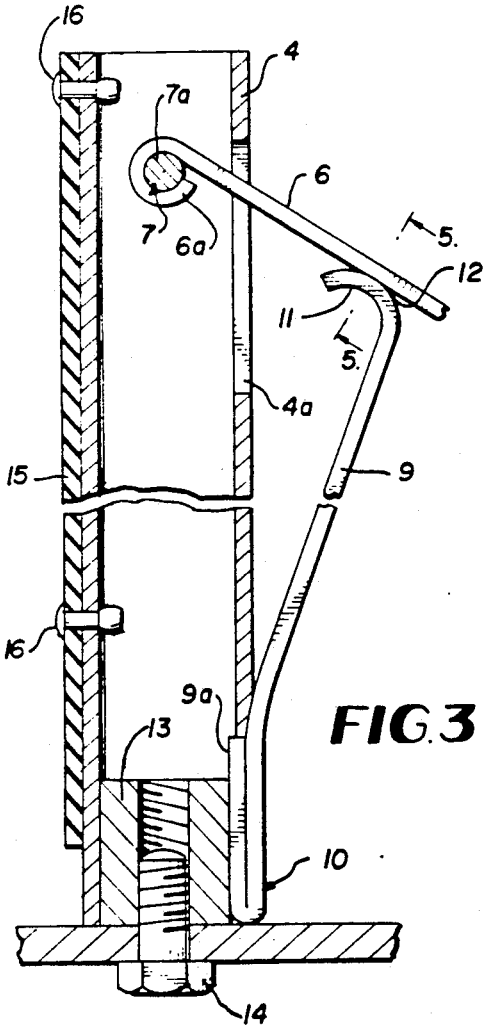
FIG.3
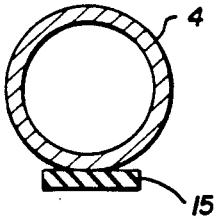
FIG.4

FIG.5
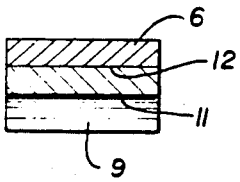
FIG.6
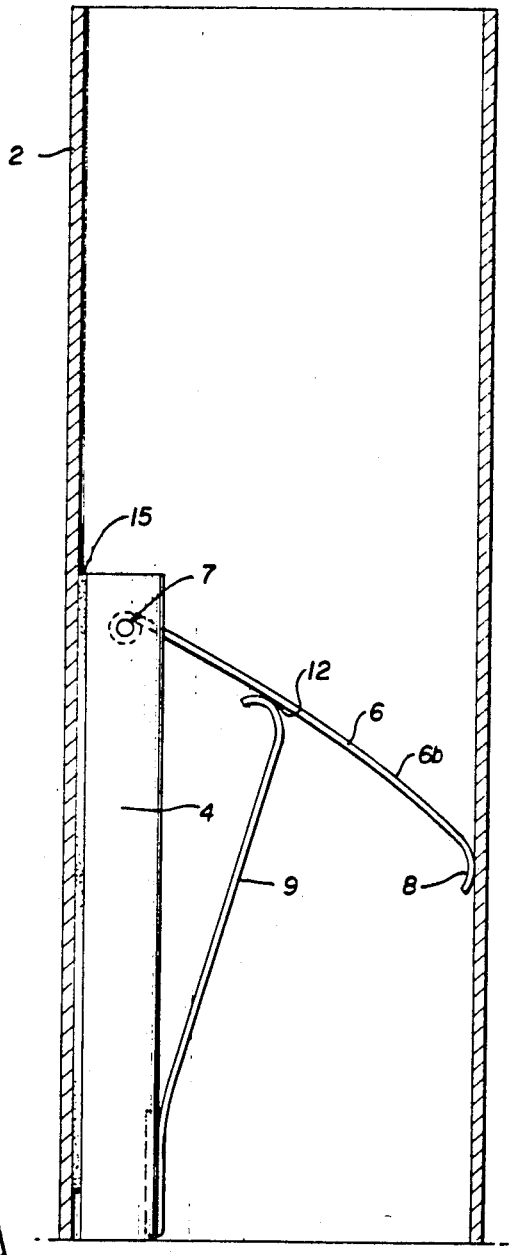
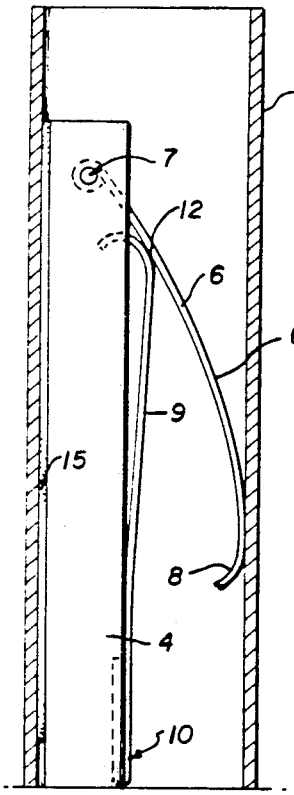
FIG.7
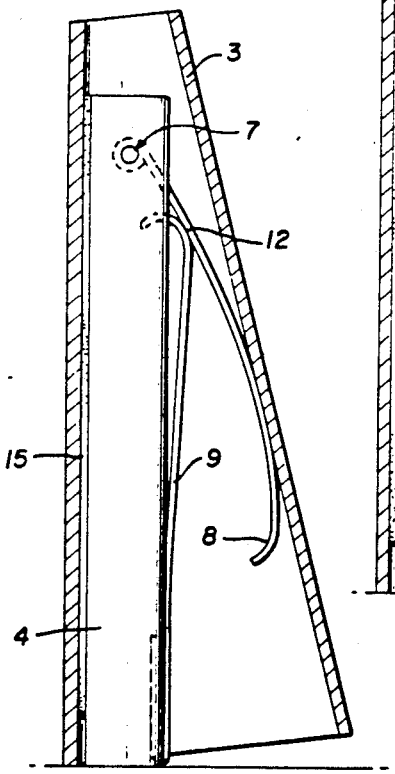
FIG.8

FIG.9
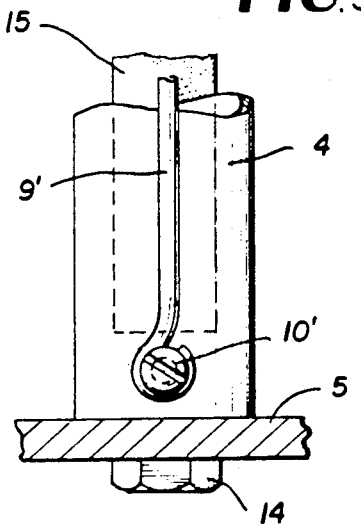
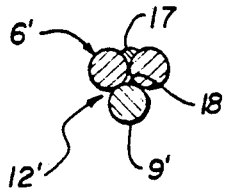
FIG.10
FIG.11
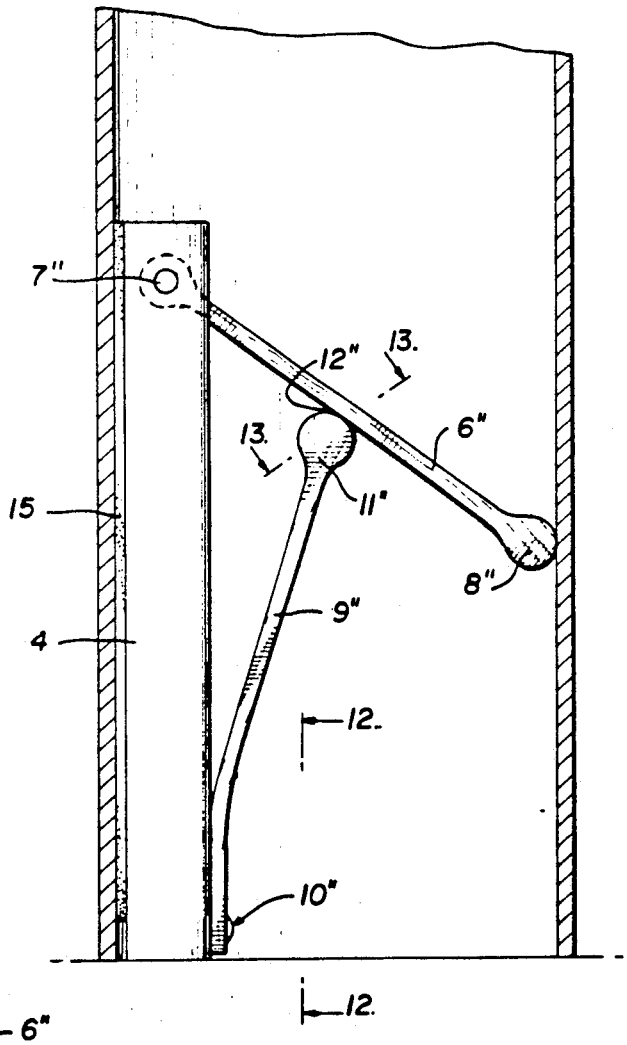
FIG.12
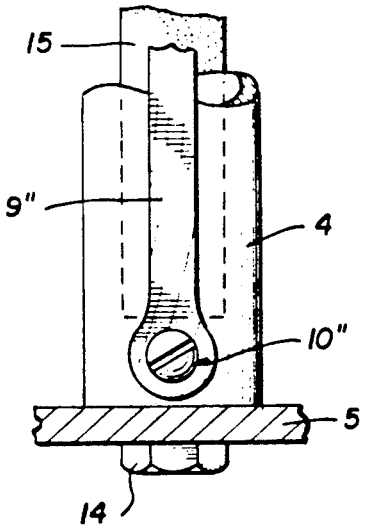
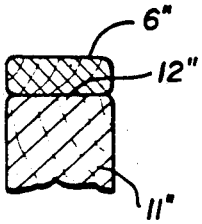
FIG.13

YARN PACKAGE HOLDER

CROSS REFERENCE TO RELATED APPLICATION

This application is a continuation-in-part of application Ser. No. 07/511,797, filed Apr. 20, 1990, now U.S. Pat. No. 5,039,026.

BACKGROUND OF THE INVENTION

This invention relates to a yarn package holder for textile machines having a creel to support and hold cylindrical and conical tubes upon which the yarn is wound to form a yarn package, and from which the yarn is withdrawn during operation of the machine.

In order to accommodate yarn package tubes having various diameters, holders have been provided having arms or legs which are biased radially outwardly to engage the inner surface of the hollow tube upon which the yarn is wrapped. The biasing force is obtained either by the inherent resiliency of the material from which the arms or legs are made, as disclosed in U.S. Pat. No. 2,283,373, dated May 19, 1942, or by a spring engaging the arm for biasing the arm radially outwardly as disclosed in U.S. Pat. Nos. 4,728,055, dated Mar. 1, 1988, and 4,760,977, dated Aug. 2, 1988.

While these holders facilitate the installation and removal of the package on the creel with one hand, they have been characterized by certain disadvantages; particularly, the necessity of forcing the arms or legs of the holder against the inside surface of the cone or tube. Most cones or tubes used in the textile industry are made of paper or plastic, and when forced over such holders, the pressure against the inside surface of the cone or tube is so great that it causes damage to the tube or cone. The smaller the size of the tube or cone that is placed over such holders, the greater the pressure against the radially outwardly biased arms or legs of the holder; consequently, it has heretofore been impossible to provide a holder which fits all commonly used sizes of yarn packages. If the holder was made large enough to hold large yarn packages, it would be impractical to hold small packages, because the radially outwardly biased arms or legs would subject the small tube or cone to excessive internal pressure resulting in the tube or cone being torn or worn. This is particularly so when the textile machinery is being operated in an atmosphere of very high humidity which is often the case, since some yarns are stronger when wet.

In order to accommodate the holder to both small and large yarn packages, it has been proposed to provide the holder with a plurality of arms of various sizes to accommodate the respective large and small yarn packages, as disclosed in the aforementioned U.S. Pat. No. 4,760,977, or to provide the base support arm of the holder with a detachable spacer bar, as disclosed in the aforementioned U.S. Pat. No. 4,728,055. Neither proposal has proven satisfactory because the plurality of variously-sized arms do not provide uniform internal pressure for all sizes of yarn packages, and the detachable spacer bar resulted in an increase of time and expense to handle the installation of the spacer bar to accommodate larger packages, and the removal of the spacer bar to accommodate smaller packages.

After considerable research and experimentation, the yarn package holder disclosed in my aforementioned patent application was devised for accommodating all sizes of yarn package tubes or cones and providing uniform holding pressure, to thereby prevent damage to the internal surface of the tubes or cones by excess internal pressure, and comprises, essentially, a contact arm or rod connected at one end portion in a cantilevered manner to a base support which is operatively connected to a creel. The contact arm engages the inside surface of the yarn package tube or cone, and one end of a spring member is pivotally connected to the distal end portion of the contact arm and extends therefrom in a direction toward the one end portion of the contact arm. A second spring member has one end fixedly secured to the one end portion of the contact arm and extends therefrom in a direction toward the distal end of the contact arm. The end portion of the second spring member engages the first spring member and biases it radially outwardly, whereby tubes and cones of various sizes can be mounted on the contact arm.

The spring members may consist of steel, wood or plastic leaf springs, or steel wire springs.

SUMMARY OF THE INVENTION

In the continuing research and development of the yarn holder disclosed in the aforementioned patent application, it has been found that if the fixed, cantilevered, contact arm or rod is provided with a friction surface, the yarn packages are held better than if there is no friction surface.

While U.S. Pat. No. 4,728,055, dated Mar. 1, 1988, discloses the use of friction material on the curved contoured arm of a yarn package holder, this has not been found to be entirely satisfactory because, when mounting a yarn package on the holder, it is necessary to slide the inside of the yarn package tube or cone directly against the friction material covered portion on the contoured arm, resulting in damage to the fragile paper cones or tubes because the purpose of the friction material is to prevent such sliding.

Furthermore, when the friction material is installed on the contoured arm, or an outwardly bowed portion of the contact arm, there is a very small contact area with the inside of the cone or tube, thereby limiting the holding ability of the yarn package holder.

With the friction material applied to the fixed, cantilevered contact arm of the present invention, instead of on the movable pivotally connected member, the cone or tube can be mounted on the holder by inserting the tube on the end of the holder while pushing one side of the tube in a direction to compress the spring members whereby the opposite side of the tube becomes spaced from the contact arm. After the cone or tube has been slid in place, the tube is released and the biasing force of the spring members causes the opposite side of the tube to engage the friction surface on the contact arm.

BRIEF DESCRIPTION OF THE DRAWINGS

FIG. 1 is a perspective view showing the various shaped yarn tubes adapted to be held by the holder of the present invention;

FIG. 2 is a perspective view of one embodiment of the holder of the present invention;

FIG. 3 is a fragmentary side elevational view of the holder taken along line 3—3 of FIG. 2;

FIG. 4 is a view taken along line 4—4 of FIG. 2;

FIG. 5 is a view taken along line 5—5 of FIG. 3;

FIG. 6 is a side elevational view of a relatively large diameter yarn tube mounted on the holder illustrated in FIG. 2;

FIG. 7 is a side elevational view of a relatively small diameter yarn tube mounted on the holder illustrated in FIG. 2;

FIG. 8 is a side elevational view of a conical yarn holder mounted on the holder illustrated in FIG. 2;

FIG. 9 is a fragmentary, side elevational view similar to FIG. 4 showing another embodiment of the holder wherein the cantilevered spring members are formed of wire;

FIG. 10 is a sectional view similar to FIG. 5, showing the embodiment illustrated in FIG. 9;

FIG. 11 is a fragmentary, sectional, side elevational view showing still another embodiment of the holder wherein the cantilevered spring members are formed from wood;

FIG. 12 is a view taken along line 12—12 of FIG. 11; and

FIG. 13 is a view taken along line 13—13 of FIG. 11.

DESCRIPTION OF THE PREFERRED EMBODIMENTS

Referring to the drawings, and more particularly to FIGS. 1 and 2, the yarn package holder 1 of the present invention is readily adapted to hold package tubes 2 and yarn package cones 3 of various sizes, and comprises, a contact arm or rod 4 connected at one end portion to a base support 5 in a cantilevered manner, it being understood by those skilled in the art that the base support 5 is operatively connected to a creel, not shown.

A first leaf spring 6 has one end pivotally connected to the distal end portion of the contact arm 4 as at 7, and extends outwardly therefrom with the free end thereof having a bent portion 8 adapted to engage the inner wall surface of a package tube 2 or cone 3, to be described more fully hereinafter. A second leaf spring 9 has one end fixedly secured to the one end portion of the contact arms g, as at 10, FIG. 3, and extends therefrom in a direction toward the distal end of the contact arm 4. The free end of the second leaf spring 9 is also provided with a bent portion 11 which engages the first leaf spring as at 12.

The details of the construction of the contact arm 4, the pivotal connection 7 and fixed connection 10 are illustrated in FIG. 3, wherein it will be seen that the contact arm 4 comprises an open ended tubular member having a slot 4*a* provided in the wall thereof through which the first leaf spring 6 extends, the pivotal connection 7 being provided by a diammetrically extending pin 7*a* fixedly mounted in the contact arm, the end 6*a* of the leaf spring being bent around the pin 7*a*.

The fixed connection 10 comprises a reversely bent portion 9*a* provided on the end of the second leaf spring 9 which extends into the tubular arm 4 and is held therein by a long hex nut 13 press-fit into the tubular arm 4. The tubular arm 4 is secured to the base support plate 5 by a bolt 14 extending through the base support and threaded into the nut 13.

In order to further enhance the holding of the tube 2 or cone 3 on the holder, a strip 15 of friction material is secured to the side of the contact arm 4 opposite from the spring members 6 and 9. While the friction material 15 is shown secured to the contact arm by rivets 16, the friction material can be applied to the arm in another manner such as by screws, adhesives, by coating the friction material on the contact arm, or forming the entire arm of friction material which can consist of plastic, rubber, cork, sandpaper, and the like.

The operation of the holder embodiment shown in FIGS. 2 and 3 is illustrated in FIGS. 6, 7 and 8, wherein it will be seen that the holder is readily adaptable for holding yarn package tubes 2 of various sizes, FIGS. 6 and 7, as well as yarn package cones 3, FIG. 8, wherein one side of the inner surface of the tube or cone engages the friction material on the contact arm 4 and the free end of the leaf spring 6 engages the opposite side of the inner surface of the tube or cone. When the yarn package tubes 2 or cones 3 are placed on the free end of the contact arm 4, the leaf springs 6 and 9 are compressed and slide against each other as the package is being installed, wherein the side of the tube 2 or cone 3 abutting the spring member 6 is manually pushed against the spring members 6 and 9 to compress the spring members while causing the opposite side of the tube 2 or cone 3 to be spaced from the friction material while sliding the tube 2 or cone 3 onto the holder. Once the yarn package is manually released, the leaf springs 6 and 9 bias the opposite side of the tube 2 or cone 3 against the friction surface 15 on the contact arm 4.

As will be seen in FIGS. 6 to 8, the point of contact 12 or fulcrum between the springs is displaced in direct relation to the inside diameter of the respective tube or cone. Thus, for instance, in FIG. 7, the fulcrum point 12 is closer to the pivotal connection 7 when a tube of small diameter is mounted on the holder, than when a tube of large diameter is mounted thereon, as shown in FIG. 6. By this construction and arrangement, an equal biasing force is applied to the inside surface of the tubes or cones, throughout the whole range of movement of the leaf springs 6 and 9, no matter what their size might be. In other words, no greater pressure is applied to a tube or cone with a 1½" inside diameter than is applied to a yarn package tube or cone having a 3" inside diameter.

While the embodiment of the holder as shown and described in connection with FIGS. 2 to 8 employs metallic leaf springs 6 and 9, FIGS. 9 and 10 disclose another embodiment wherein the spring members 6' and 9' comprise wires. Wire spring 9' is fixedly connected to the contact arm 4 as at 10', and wire spring 6' consists of a pair of wires welded together as at 17, the trough 18 being formed therein providing the point of contact 12' or fulcrum between the wire springs 9' and 6'.

Still another embodiment of the invention is illustrated in FIGS. 11, 12 and 13, wherein the spring members 6" and 9" are formed from wood. Spring member 9" is fixedly secured to the end of the contact arm, as at 10". The spring member 6" is pivotally connected to the contact arm 4 as at 7", and the free ends of each of the spring members are provided with bulbous portions 11" and 8", for engaging, respectively, the spring member 6" and the inside wall surface of the tube 2.

From the above description, it will be readily apparent to those skilled in the art that the construction and arrangement of the spring members in the yarn package holder of the present invention provide an improved holder wherein an equal biasing holding force is employed for all sizes of yarn package tubes or cones than heretofore provided by known holders, wherein more force is applied against smaller tubes or cones than larger tubes when placed on the same holder. Furthermore, by employing flat or longitudinally extending wire spring members, the spring members can be folded into a much smaller space than obtainable by using other types of springs, such as coil springs, thus increasing the range of package sizes installable on the holder.

Furthermore, by providing the contact arm 4 with an extended friction surface 15 rather than the tube engaging portion of the spring members 6, 6' and 6'', the yarn package can be mounted on the holder without damaging the fragile tubes 2 or cones 3 and the holding ability of the yarn package holder is enhanced.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A holder for receiving and frictionally securing packages of yarn wound onto hollow tubes and cones of various inner diameters comprising, a base support adapted to be, attached to a creel for a textile machine, a contact arm, a seperate layer of friction material applied to said contact arm providing a friction surface thereon for contacting an inside wall of a selected yarn tube and cone, one end portion of said contact arm being rigidly connected to said base support, said contact arm extending from said base support in a cantilevered manner, a first spring member, a pivot connecting one end of said first spring member to the distal end portion of the contact arm, the free end of said first spring member extending in a direction toward the said one end portion of the contact arm, a second spring member positioned between said contact arm and said first spring member, means fixedly connecting one end of said second spring member to the said one end portion of said contact arm, said second spring member extending from said fixed connection in a direction toward the distal end portion of the contact arm, the other end of the second spring member engaging the first spring member to form a displaceable fulcrum therewith, the second spring member biasing the first spring member radially outwardly of said contact arm, whereby the friction surface on the contact arm and the free end of said first spring member are urged against opposite inside wall surfaces of the selected tube and cone, to thereby hold the selected tube and cone on the holder while applying an equal biasing force to the inside surface of the tubes and cones no matter what their size might be.

2. A yarn package holder according to claim 1, wherein the spring members comprise metallic leaf springs.

3. A yarn package holder according to claim 1, wherein the spring members comprise longitudinally extending wires.

4. A yarn package holder according to claim 3, wherein the first spring member comprises a plurality of side-by-side wires integrally connected, and the second spring member comprising a single wire.

5. A yarn package holder according to claim 1, wherein the spring members are formed from wood.

6. A yarn package holder according to claim 1, wherein the means fixedly connecting one end of the second spring member to the said one end portion of the contact arm comprises, a reversely bent portion on said one end of said second spring member, said reversely bent portion extending into the said one end portion of the contact arm, and a nut secured in the said one end portion of said contact arm for frictionally holding the reversely bent portion of the second spring member therein, and a bolt extending through said base support and threaded into said nut.

7. A yarn package holder according to claim 1, wherein the friction material comprises a strip of friction material secured to the outer surface of the contact arm on the side of the arm opposite from the first and second spring members.

8. A yarn package holder according to claim 7, wherein the strip of friction material extends substantially the length of the contact arm.

* * * * *